US005347659A

United States Patent [19]

Tibljas

[11] Patent Number: 5,347,659

[45] Date of Patent: Sep. 20, 1994

[54] CAMOUFLAGE GARMENT

[76] Inventor: Edward J. Tibljas, Rte. 1, Box 62E, Granbury, Tex. 76048

[21] Appl. No.: 58,139

[22] Filed: May 10, 1993

[51] Int. Cl.[5] ..... A41D 3/02

[52] U.S. Cl. ..... 2/84; 2/1; 2/243.1; 428/919

[58] Field of Search ..... 2/84, 85, 94, 1, 243 R, 2/243A, 243.1; 428/24, 52, 919, 17, 100, 15, 17, 16

[56] References Cited

U.S. PATENT DOCUMENTS

| | | | |
|---|---|---|---|
| 1,139,642 | 5/1915 | Cox | 428/919 |
| 2,351,142 | 6/1944 | Mitchell | 428/919 |
| 2,642,571 | 6/1953 | Brown | 2/1 |
| 4,106,124 | 8/1978 | Green | 428/919 |
| 4,285,068 | 8/1981 | Ross | 428/919 |
| 4,517,230 | 5/1985 | Crawford | 2/94 |
| 4,781,959 | 11/1988 | Gottlieb | 428/919 |
| 4,792,471 | 12/1988 | Lee | 2/94 |
| 4,931,320 | 6/1990 | Leonard | 428/919 |
| 5,013,375 | 5/1991 | Leonard | 428/919 |
| 5,203,033 | 4/1993 | Sheppard, Sr. | 2/94 |

FOREIGN PATENT DOCUMENTS

| | | | |
|---|---|---|---|
| WO03082 | 5/1987 | PCT Int'l Appl. | 428/919 |

OTHER PUBLICATIONS

Gander Mountain Catalogue, 1966, showing camouflage suits.

*Primary Examiner*—Clifford D. Crowder
*Assistant Examiner*—Gloria Hale
*Attorney, Agent, or Firm*—E. Michael Combs

[57] ABSTRACT

A garment arranged to enclose an individual includes a torso, leg portions, and sleeves, having a base web, with the base web including a matrix of loop members pivotally mounted in adjacency relative to one another coextensively over the garment. The garment base web, as well as the loop members, are formed of a camouflage material arranged to minimize reflection of light relative to the garment structure. Cooperative hood and glove members are provided for use with the organization.

3 Claims, 4 Drawing Sheets

CAMOUFLAGE GARMENT

BACKGROUND OF THE INVENTION

1. Field of the Invention

The field of invention relates to camouflage garments, and more particularly pertains to a new and improved camouflage garment wherein the same is arranged to minimize light reflection to enhance blending and camouflaging of an individual relative to a surrounding environment.

2. Description of the Prior Art

The use of camouflage garments by soldiers, hunters, and the like is available in the prior art, wherein such garment structure is exemplified in the U.S. Pat. No. 4,656,065; 4,517,230; and 5,010,859.

The instant invention attempts to overcome deficiencies of the prior art by providing, in addition to camouflage garment patterning of a fabric, the coextensive mounting of loop members coextensively of the garment to effect the absorption of light to assist in blending of an individual relative to a surrounding environment.

SUMMARY OF THE INVENTION

In view of the foregoing disadvantages inherent in the known types of camouflage garments now present in the prior art, the present invention provides a camouflage garment wherein the same is arranged to include a matrix of flexible and pivotally mounted loop members mounted coextensively of the garment structure. As such, the general purpose of the present invention, which will be described subsequently in greater detail, to provide a new and improved camouflage garment which has all the advantages of the prior art camouflage garments and none of the disadvantages.

To attain this, the present invention provides a garment arranged to enclose an individual including a torso, leg portions, and sleeves, having a base web, with the base web including a matrix of loop members pivotally mounted in adjacency relative to one another coextensively over the garment. The garment base web, as well as the loop members, are formed of a camouflage material arranged to minimize reflection of light relative to the garment structure. Cooperative hood and glove members are provided for use with the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures;, methods and systems for carrying out the several purposes of the present invention. It is important, therefore, that the claims be regarded as including such equivalent constructions insofar as they do not depart from the spirit and scope of tile present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor As it intended to be limiting as to the scope of the invention in any way.

It is therefore an object of the present invention to provide a new and improved camouflage garment which has all the advantages of the prior art camouflage garments and none of the disadvantages.

It is another object of the present invention to provide a new and improved camouflage garment which may be easily and efficiently manufactured and marketed.

It is a further object of the present invention to provide a new and improved camouflage garment which is of a durable and reliable construction.

An even further object of the present invention is to provide a new and improved camouflage garment which is susceptible of a low cost of manufacture with regard to both materials and labor, and which accordingly is then susceptible of low prices of sale to the consuming public, thereby making such camouflage garments economically available to the buying public.

Still yet another object of the present invention is to provide a new and improved camouflage garment which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
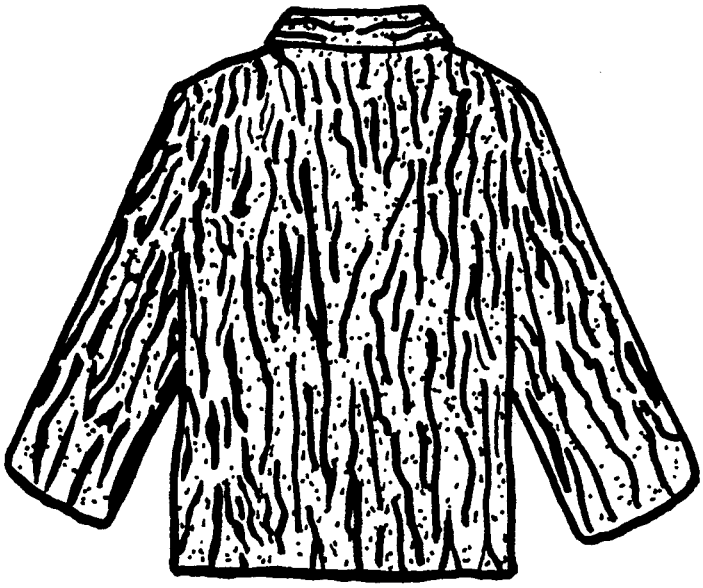
FIG. 1 PRIOR ART
FIG. 1 is an orthographic view of a prior art camouflage garment structure.
Figure 2:
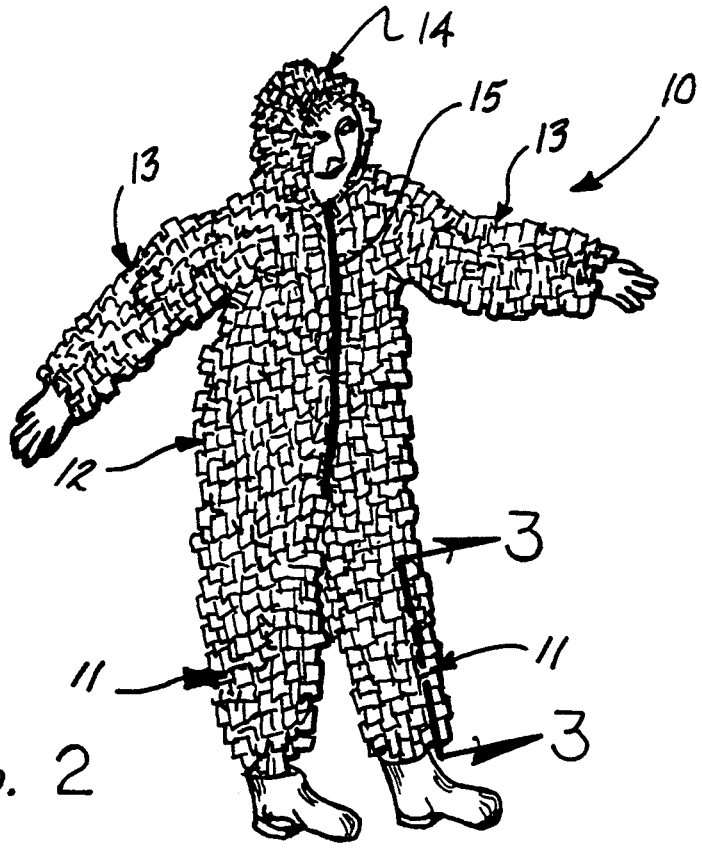
FIG. 2 is an orthographic view of the invention.
Figure 3:
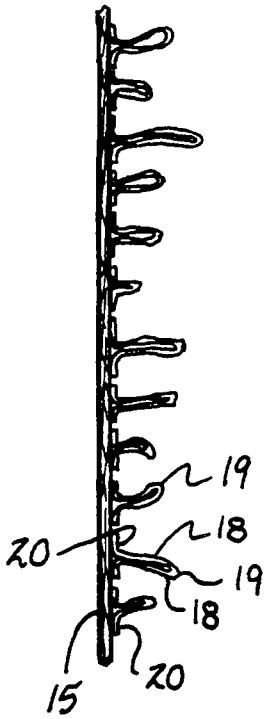
FIG. 3 is an orthographic view, taken along the lines 3—3 of FIG. 2 in the direction indicated by the arrows.
Figure 4:
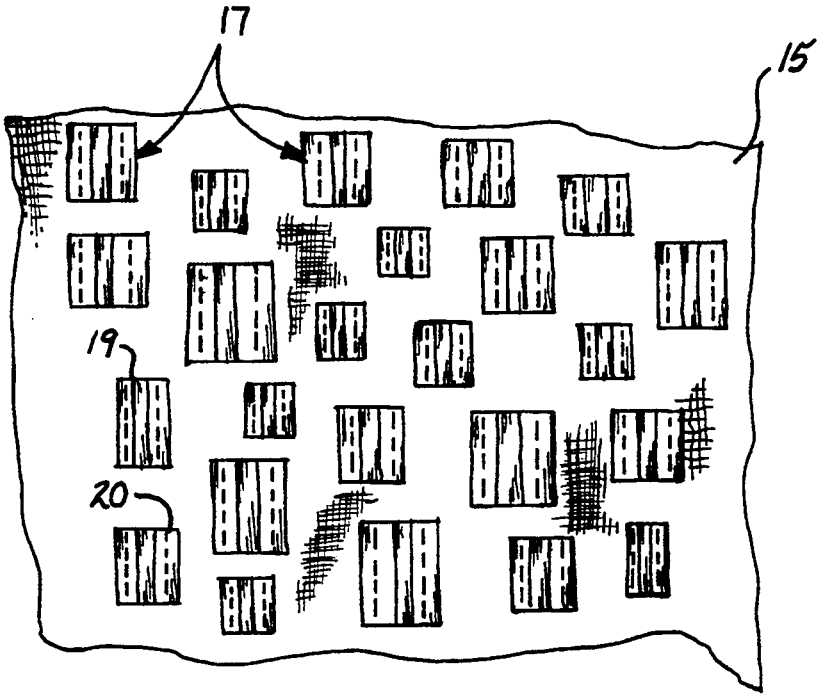
FIG. 4 is an expanded view of the base fabric and the loop members mounted thereon, with the loop members arranged in an exaggerated spaced relationship relative to one another.

With reference now to the drawings, and in particular to FIGS. 1 to 8 thereof, a new and improved camouflage garment embodying the principles and concepts of the present invention and generally designated by the reference numeral 10 will be described.

FIG. 1 indicates a prior art camouflage garment structure, as presented in U.S. Pat. No. 4,656,065, having a particular camouflage pattern, incorporated herein by reference. It should be noted that camouflage patterns are subject to variance relative to the environment wherein the garment is to be used relative to desert, forest, and the like.

More specifically, the camouflage garment 10 of the instant invention essentially comprises a plurality of leg members 11 in communication relative to a torso portion 12, that in turn includes a plurality of arm member sleeves 13. A hood member 14 is arranged for mounting overlying the opening of the garment structure. A fastener strip 15 that may be formed of buttons, hook and loop fasteners, a zipper construction, and the like extends from the head opening to the crotch portion of the torso portion 12 oriented between the leg members 11. The garment 10 includes a flexible base web 16, having a camouflage pattern coextensive therewithin of a type as indicated in the pattern of FIG. 1 for example of the prior art, as indicated in U.S. Pat. No. 4,656,065, that such pattern is directed coextensively of the garment 10, the hood member 14, as well as the glove members 22 that are illustrated for example in FIG. 5.

The flexible base web includes a matrix of loop members 17 mounted thereon. The loop members 17 are formed coextensively of the base web 16, with the loop members 19 formed in adjacency relative to one another. The FIG. 4 indicates the loop members arranged in a spaced relationship relative to one another for exaggeration to indicate their construction, but it is to be understood that the loop members 17 are positioned in proximate adjacency relative to one another. The loop members 17 are each formed of adjacent facing web segments 18 of flexible construction extending above and beyond the flexible base web 16 jointed at a fold line 19 that is spaced relative to and in a generally parallel relationship relative to the base web 16. Each of the web segments 18 includes a securement web portion 20 for mounting to the base web, utilizing adhesives, sewn connections, and the like.

The flexible loop members 17 accordingly absorb light enhancing the camouflage construction. It should be further noted that the loop members 17 are also formed of the same camouflage pattern of the base web 16 in use.

Figure 5:
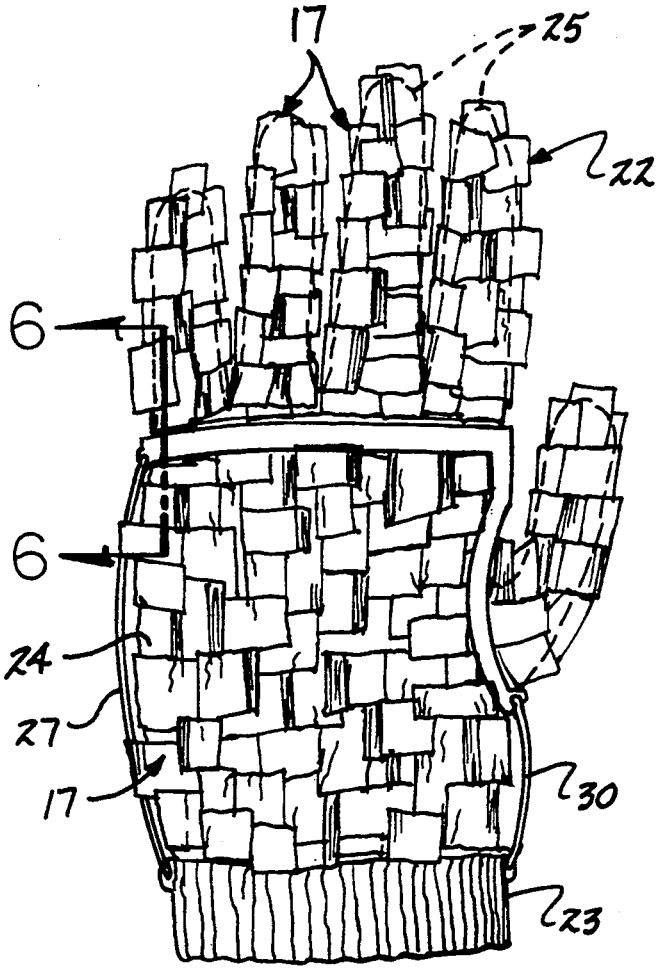
FIG. 5 is an orthographic view of a glove member employed by the invention.
Figure 6:
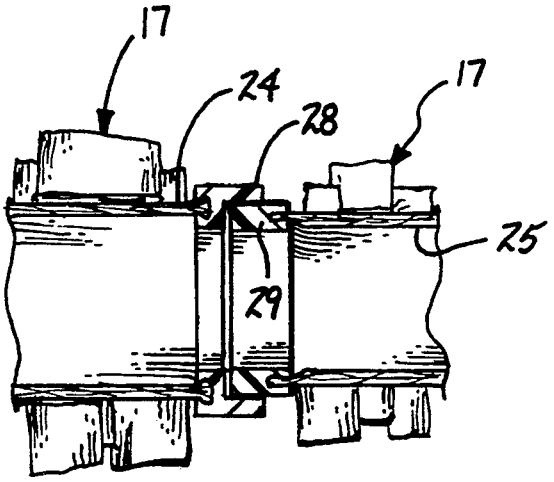
FIG. 6 is an orthographic view, taken along the lines 6—6 of FIG. 5 in the direction indicated by the arrows.
Figure 7:
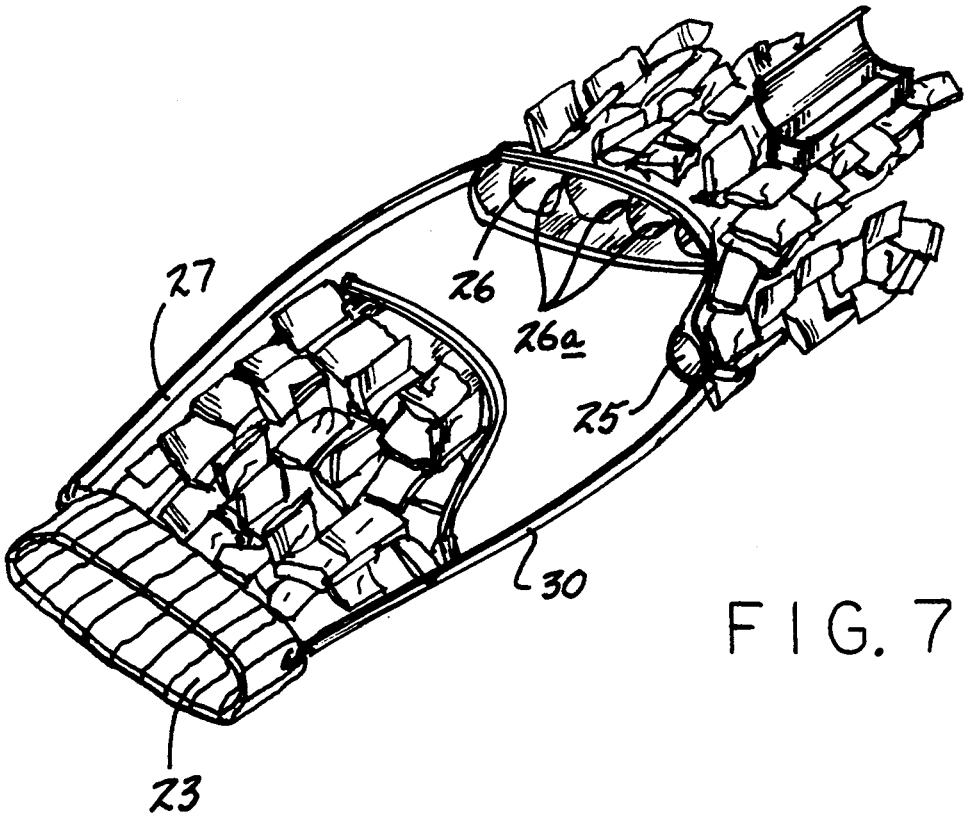
FIG. 7 is an isometric illustration of the glove member in a separated configuration.
Figure 8:
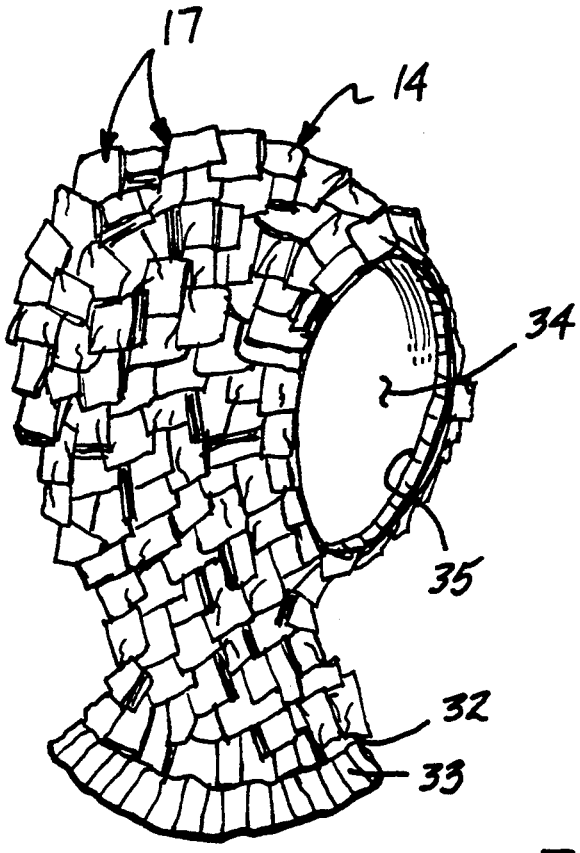
FIG. 8 is an isometric illustration of the hood member of the invention.

Each of the glove members 22, such as indicated in the FIGS. 5–7, includes a wrist portion 23 formed of elastomeric tubular configuration, with a hand web 14 extending therefrom, with loop members 17 coextensive therewith, of a construction as indicated above. The glove member 22 includes a thumb socket 25 removably mounted relative to the hand web 24, as well as a plurality of finger sockets 26 that are joined together at their base at base portions 26*a* for securement to the hand web 24. A first tether line 27 mounted at one end to the hand web 24 extends to the finger sockets 26, with a second tether line 30 extending from the hand web to the thumb socket 25. As illustrated in the FIG. 6, each of the finger sockets and thumb sockets are joined to the hand web 24 by employing a resilient first cylindrical coupling 28 mounted to the hand web 24 that frictionally and complementarily receives a second cylindrical coupling 29 mounted to an associated finger socket or thumb socket. In this manner, the finger and thumb sockets are arranged for removably mounting relative to the hand web for ease of manipulation of the fingers and thumb for use in firearms and the like.

The hood member 14 includes a neck tube 32 terminating in an elastomeric opening web 33 for securement about an individual's neck, wherein the hood member 14 includes a facial opening 34 having a surrounding elastomeric web 35 at a perimeter of the facial opening 34 to expose a minimum of individual skin for viewing of an animal and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A camouflage garment, comprising, a torso portion, having a neck opening and a plurality of leg members extending from the torso portion, and a plurality of arm member sleeves extending from the torso portion, and a fastener strip extending from the neck opening along the torso portion medially of the leg members, and the torso portion, the arm member sleeves, and the leg members are formed of a continuous base web, having a camouflage pattern coextensive therewithin, and the base web further including a matrix of closed loop members, each of the loop members arranged in adjacency relative to one another and are coextensive with the base web, and each of the loop members includes facing web segments of flexible construction, wherein each of the web segments include a securement web portion, and each securement web portion is fixedly secured to the base web, and the web segments are flexibly and pivotally mounted to the web portions, and the web segments are joined together at a fold line, wherein the fold line is spaced above the base web and is arranged in a substantially parallel relationship thereto, and the securement web portions and the web segments are each formed of a flexible material having a further camouflage pattern thereon consistent with the base web.

2. A garment as set forth in claim 1 including glove members, wherein each glove member includes a wrist portion formed of a elastomeric tubular configuration, and a hand web, the hand web includes finger sockets arranged for selective securement to the hand web, and a thumb socket, each of the finger sockets are joined together at their base portions, wherein the base portions and the finger sockets each include a second cylindrical coupling, and the hand web includes a first cylindrical coupling relative to each of the finger sockets, wherein the second cylindrical couplings are complementarily and frictionally received within the first cylindrical coupling, and a first tether line mounted to the hand web and to the finger sockets preventing loss of the finger sockets upon separation relative to the hand web, and a second tether line, with the second tether line joined to the hand web and to the thumb socket.

3. A garment as set forth in claim 2 including a hood member, the hood member including a neck tube, the neck tube having an elastomeric opening web at a perimeter of the neck tube, and the hood member including a matrix of said loop members coextensive with the exterior surface of the hood member, and a facial opening directed through the hood member, the facial opening including a further surrounding elastomeric web.

* * * * *